United States Patent [19]

Bonczyk

[11] 4,171,046

[45] Oct. 16, 1979

[54] MULTI-CELLED CONTAINER CARRIER

[75] Inventor: Bruno C. Bonczyk, East Alton, Ill.

[73] Assignee: Alton Box Board Company, Alton, Ill.

[21] Appl. No.: 877,277

[22] Filed: Feb. 13, 1978

[51] Int. Cl.[2] ..... B65D 73/00

[52] U.S. Cl. ..... 206/193

[58] Field of Search ..... 206/139, 140, 162, 170–175, 206/180–191, 193, 198; 229/28 BC

[56] References Cited

U.S. PATENT DOCUMENTS

| | | | |
|---|---|---|---|
| 2,721,001 | 10/1955 | Hasselhoff | 206/198 |
| 3,208,632 | 9/1965 | Graser | 206/187 |
| 3,784,053 | 1/1974 | Stout | 206/193 |

*Primary Examiner*—Donald F. Norton

*Attorney, Agent, or Firm*—Paul M. Denk

[57] ABSTRACT

A multi-celled container carrier constructed providing a pair of rows of article holding cells to either side of the central panel separating the carrier into two lateral compartments, with the central panel being formed of a pair of foldably connecting panels, and having a pair of aligned apertures for forming the hand-gripping means for the carrier. A blank formed for this carrier incorporates the pair of central forming panels, having side or end panels connecting to each side edge thereof, and with side walls and bottom walls connecting therewith for forming each compartment to either side of the central panel. Dividers are provided within each compartment, connecting with the connecting flaps forming each compartment, for segregating each compartment into cellular segments.

20 Claims, 6 Drawing Figures

MULTI-CELLED CONTAINER CARRIER

BACKGROUND OF THE INVENTION

This invention relates generally to a container carrier, and more specifically pertains to a carrier providing multiple rows of article holding cells for use in augmenting the quantity of articles capable of conveyance during usage.

Numerous paperboard styles of article carriers are available in the prior art, many of them being designed for furnishing generally a carrier blank that may be formed from a unitized sheet of board, folded into its carrier configuration, either piror to or during the insertion of articles within its confinement. For example, various side loading article carriers are available, and after a specified number of the articles, such as bottled or canned beverages, are located upon one such carton blank, it is then wrapped around the emplaced containers for enclosing them within the carrier or pack for shipment. The advantage of such carriers is that the fabrication of a carrier from its blank into the useable form can be performed synonymously with the loading of the beverages, or the like, therein. But, such carriers, by necessity, have been limited to the arrangement of a singular row of the article to either side of the carton, in order that any formed separation between the articles can be made so as to protect them from damage or breakage during transit.

Other styles of article carriers of similar structure to that previously defined have become available in the art, and generally are fabricated in the manner that requires substantial width of the board from which the carrier blank is cut. Such can be seen in the U.S. Pat. to Wood, No. 4,029,205. In addition, a style of carrier carton that may provide for bulk confinement of a plurality of articles is shown in the U.S. Pat. to Gordon, No. 4,029,207, and which is concerned primarily with providing for rather hidden confinement of the articles contained therein, but yet furnishing clearance for finger gripping of the carton during usage.

Another style of article carrier that furnishes only a single row of article confinement within the formed carrier is shown in the U.S. Pat. to Stout, No. 4,000,813, wherein at least four cells are arranged in single rows to either side of its medial partition structure. A related type carrier, but one which incorporates an advertising tab, is shown in the United States patent to the same inventor, U.S. Pat. No. 4,000,814.

Other styles of article carriers incorporating internal partitions for segregating the confined articles into separable cells is shown in the U.S. Pat. to Calvert, No. 4,007,830, but it would appear that the partition inserts of the shown carrier are constructed independently of the folded carton, and then slid into its open ends after locating containers therein for packaging. The supplemental steps involved in providing for more than two rows of articles can be readily comprehended upon reviewing this particular style of formed carrier.

Another variation upon an article carrier, but generally of the six pack category, is shown in the U.S. Pat. to Wood, et al, No. 4,010,847. Another style of package for orienting a plurality of articles is shown in the U.S. Pat. to Gorski, No. 4,050,579, but this particular package displays a rather rigid form of base wall incorporating a series of cylindrical confining casing members for holding containers in place, generally upon a package that rather substantially exposes the held articles for ease of viewing. Another recent bottle and glass style of carrier is shown in the U.S. Pat. to Cope, No. 4,049,116, and this also would appear to be of the wrap around style of carrier for holding a pair of rows of bottles within its interior.

The U.S. Pat. to Stout, No. 4,047,610, and also upon an article carrier, discloses what would appear to be a formed carrier that incorporates web reinforcing means for reinforcing the end wall panels of the shown carrier.

Other variations upon more recently designed multi packaging devices are shown in the two U.S. Pats. to Klygis, No. 4,018,331, and the U.s. Pat. to Werth, No. 4,024,950, with both of these designs providing a form of polymer band for tightly binding against some portion of the cylindrical formed containers, such as beverage cans, and providing the only means for holding a pack of the containers together. This type of packaging means is effective for confining beverages that are packaged within cans, but would not appear to have sufficient safety for use in the packaging of glass articles.

The foregoing discussion of the prior art reviews the various style of article carriers or suspensions that are of more recent patantable vintage, but, it would further appear that their structures generally do not comprehend the type of features that are desired for the multi-celled container carrier of this invention. It is, therefore, the principal object of this invention to provide a container carrier that may hold a plurality of frangible articles, such as glass bottles, completely separated by carton insulation from each other, but yet being formed incorporating a plurality of rows of the cellular compartments for holding a greater number of such articles than heretofore provided in the prior art.

Another object of this invention is the provision of a multi-celled container carrier incorporating at least a pair of rows of article holding cells to either side of its central panel, but yet with the carrier being formed entirely from a single length of the board forming the carrier blank.

Another object of this invention is the provision of a container carrier that is fully reinforced by means of supplemental hand gripping panels and strategically located gussets so as to enhance the strength of the container at those positions where carton fatigue is more likely to occur.

Yet another object of this invention is the provide a integral carton blank incorporating a multi-foldable divider means that is useful for segregating each lateral compartment of the carrier into at least a pair of rows of fully insulated and separable cells for individual confinement of frangible articles at either side of the formed carton.

Still another object of this invention is the provision of means for furnishing temporary retention in position of various carton components during its erection from a unitary blank of paperboard.

These and other objects will become more apparent to those skilled in the art upon reviewing the summary of this invention and upon undertaking a study of its preferred embodiment in view of the drawings.

SUMMARY OF THE INVENTION

As previously briefly commented, this invention contemplates the formation of a container carrier for use in holding a plurality of frangible articles, such as glass containers, supported within the carrier, and do so through the agency of at least a pair of rows of article supporting cells to either side of a central panel, which panel is disposed for grasping, as by the hand, during carrier conveyance. The blank for this carrier is formed having a pair of main panels which are foldably connected at their contemplated upper edge, and which when folded together, in juxtaposition, provide a double walled central panel that acts as the divider between two lateral article supporting compartments to either of its sides. Provided connecting to one side edge of the pair of central forming panels are the end walls, one for each end of each of the aforesaid compartments, while the opposite end wall for each compartment foldably connects with the other side edge of each of the central forming panels. The side walls for each of the carrier compartments connect to the other edges of each of these opposite end walls, with a connecting flap foldably secured to the other edges of each of the said side walls. These connecting flaps, for each compartment, are folded back around in the formation of the rectangular structured compartments, and therein are adhesively connected respectively with the first mentioned end walls of each compartment. The bottom walls connect at the intended lower edges of the aforesaid side walls, and these bottom walls are folded underneath the formed carrier, adhered together by means of an adhesive, or the like, just beneath the proximity of the lower edge of the central formeng pair of panels, and are secured proximate this lower edge by means of integral detents or fasteners that are formed extending downwardly from the central panel and are conveniently lockingly inserted within aligned apertures formed through at least one of the arranged bottom walls. Thus, in this configuration, the carrier undertakes the formation of a pack carrier having the multiple rowed compartments for holding an equal number of articles to either of the sides of its central panel, therefore being equally balanced in weight as when being carried through the agency of the hand gripping means furnished in the upward reaches of the said central panel. To further reinforce the bottom wall of the formed carrier, and to insure that its various walls and connecting flaps remain reasonably erect during its formation, a series of gussets integrally formed also of the same paperboard from which the carrier is constructed are arranged between certain of the aforesaid walls and panels, and provide structural reinforcement for the carrier to support the weight of the plurality of articles held thereby, as during its usage. For example, the article carrier of this invention is designed having at least the pair of rows of cellular areas into which individual articles may be inserted, and in the preferred embodiment, each row is capable of holding at least three articles therein. Thus, in the preferred embodiment, as shown, at least twelve beverage or other liquid laden containers may be fully supported by this carrier during its transit and conveyance.

To further insure the safety of the usually breakable containers held by this type of a pack carrier, it is desirable to furnish some form of dividing means within each compartment to thereby form the individual cells into which the articles are inserted, and at the same time, separate and insulate each article from the other so that there will be no glass-to-glass contact during carrier usage. To achieve this, the blank further incorporates divider means that are foldably connected with the connecting flaps of each compartment, with the divider forming a midpanel arranged substantially longitudinally of and parallel with the central panel of the carrier, but generally separating its compartment into discrete halves. And, each divider is formed having cut out portions that may be bent generally perpendicularly from its midpanel, with these portions disposed for adherence to either the inner surface of the side wall of its compartment, or to that proximate panel forming the central panel of the carrier. Thus, there are sufficient cut out portions from the midpanel so as to insure a separation of the carrier, at least in the preferred embodiment, into six compartments disposed to either side of the said central panel portion.

Each divider means, and more specifically its midpanel, is formed from a pair of foldably connected panels, with the cut out portions from one of the panels extending in one lateral direction towards the inner surface of the aforesaid side walls, while the cut out portions from the other panel forming the midpanel being directed towards the proximate central panel, and being adhered thereto, for forming the cellular separations within this inner row of each compartment. In addition, and to insure that adequate reinforcement is provided for the midpanel, and that sufficient closure will be furnished at those regions where the cut out portions are bent free of its mid panel, so as to fully insulate each frangible article from the next adjacent ones, a spacer panel is foldably connected to the ends of each divider means, and arranged for folding back approximately 180° to be arranged intermediate the two pair of panels which fold together into juxtaposition when forming the midpanel for each compartment.

DESCRIPTION OF THE PREFERRED EMBODIMENT

Figure 1:
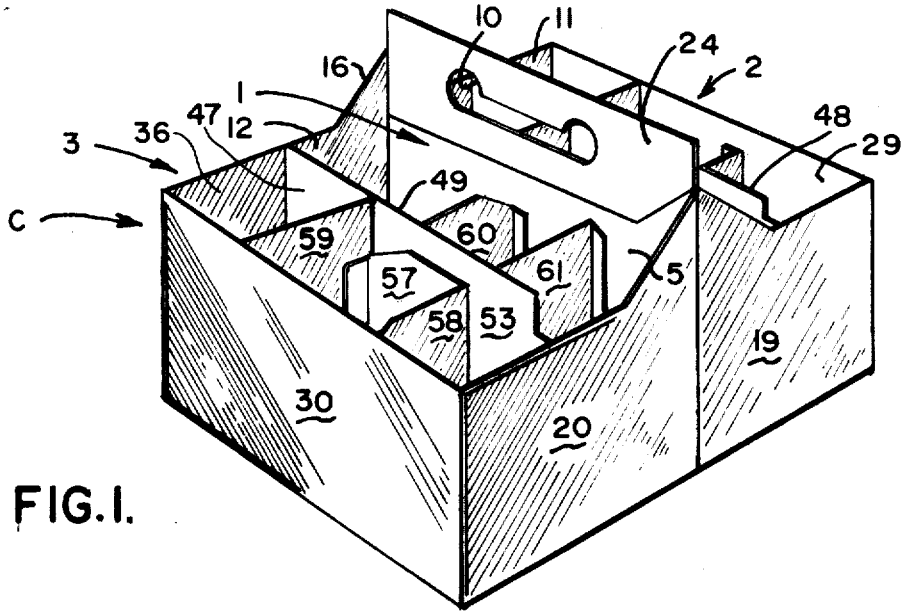
FIG. 1 provides an isometric view of the fully folded multi-celled container carrier of this invention.
Figure 2:
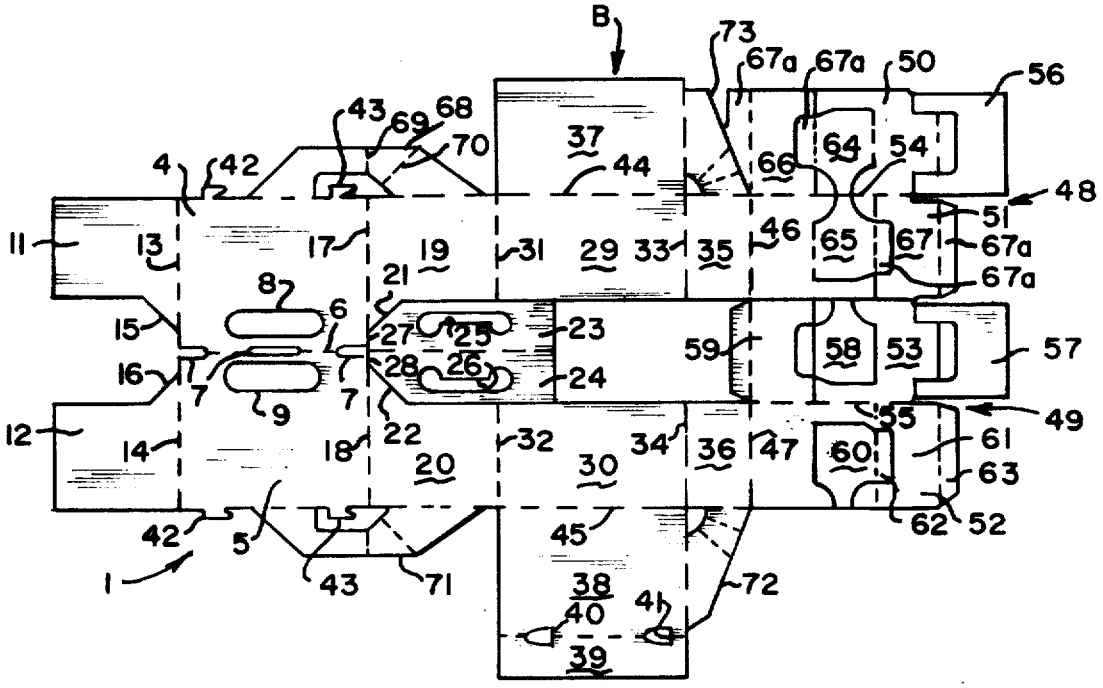
FIG. 2 provides a view of the unitized blank cut from a segment of paperboard, and before any folds are made towards its formation into the aforesaid carrier, as shown in FIG. 1.

In the drawings, and in particular FIG. 1, there is disclosed the multi-celled container carrier C of this invention, and in referring to also FIG. 2, it can be seen that the carrier is fabricated from an integral blank B, and is formed having a central panel 1, forming a pair of compartments 2 and 3 to either of its sides. More specifically, the central panel 1 is formed from a pair of panels 4 and 5, which are held to each other along a fold line 6, and which is partially slotted, as at 7, so as to facilitate the folding of the panels 4 and 5 downwardly and against each other as during the initial stages of formation of this carrier. A pair of apertures 8 and 9 are cut into the eventual upper segments of the panels 4 and 5, as shown, so that when they are folded against each other into the formation of a central panel, these apertures 8 and 9 shift into alignment so as to form a hand gripping slot 10 for facilitating the conveyance of this carrier C. Connecting to one side edge of each of the panels 4 and 5 are first end walls 11 and 12, respectively, being attached to said panels through the agency of the fold lines 13 and 14, as shown. These intended end walls 11 and 12 are cut having beveled upwardly extending integral portions 15 and 16, respectively, so as to enhance the reinforcement of the carrier proximate the ends of the hand gripping area.

Connecting along the fold lines 17 and 18 at the other side edges of the panels 4 and 5, respectively, are the opposite end walls 19 and 20 of the carrier. These walls also include beveled portions 21 and 22, once again, for enhancing the reinforcement of the carrier proximate its hand gripping slot 10.

Further cut from the blank are a pair of hand gripping reinforcing members 23 and 24, also having slots 25 and 26 cut therein, with these portions being connected along the fold lines 27 and 28, so that when the members 23 and 24 are folded over approximately 180°, in adjacency against the upper portions of the panels 4 and 5, and in alignment with the apertures 8 and 9, they furnish a double reinforcement for the hand gripping area of the central panel, as during its usage.

Connecting with the other side edge of each of the opposite end walls 19 and 20 are the side walls 29 and 30 for the carrier, being secured to said end walls by means of the fold lines 31 and 32, respectively. Thus, it can be seen that the length of dimensions of the side walls 29 and 30 are somewhat equivalent to the length of the central forming pair of panels 4 and 5, and in the folded carrier, together form the length of the formed carrier. Additionally, connecting to the opposite edges of the side walls 29 and 30, as by means of the fold lines 33 and 34, are the connecting flaps 35 and 36, respectively, and in the folded configuration, these connecting flaps 35 and 36 are adhesively secured to approximately half of the inner surface of the end walls 11 and 12, so as to form the walled compartments 2 and 3 to either side of the carrier. This can also be seen in FIG. 5.

Also connecting to another edge of the side walls 29 and 30 are a pair of bottom walls 37 and 38, respectively, so that when the carrier is folded into its enclosing configuration, each of these bottom walls 37 and 38 provide for coverage under the respectively formed compartments 2 and 3, with the slight overlap formed by reason of the additional panel 39 forming a glue flap for adherence to the bottom wall 37. As can also be seen, a pair of apertures 40 and 41 are cut through the margin between the bottom wall 38 and the additional panel 39, and these apertures are aligned for reception in locking engagement with the detents or connectors 42 and 43 extending downwardly from the central panel 1, so as to interlock the said bottom walls 37 and 38 against the bottom of the said carrier, and more specifically to its central panel. The opposite edges of the bottom walls 37 and 38, being connected along the fold lines 44 and 45 to their respective side walls 29 and 30, provide sufficient securement to the bottom walls at these locations to prevent any untimely dropping of any conveyed article through the carrier.

Also connecting along the fold lines 46 and 47 to the connecting flaps 35 and 36, respectively, are the compartment divider means 48 and 49. Each of these divider means is formed as a midpanel, as shown in FIG. 1, with each midpanel comprising a pair of panels. The pair of panels 50 and 51 form the midpanel for the divider means 48, while the pair of panels 52 and 53 form the midpanel for the divider means 49. The panels 50 and 51 are connected together by means of a fold line 54, while the pair of panels 52 and 53 are connected together by means of the fold line 55. Each of these pair of panels are folded over approximately 180° to form a double form of midpanel for their respective divider means 48 and 49. Each of the panels 50 and 53 have hingedly connected to them a spacer panel 56 and 57, respectively, and which spacer panels are folded over in the formed carrier approximately 180° to provide for further reinforcement and spacing between their respective adjacently folded panels 50 and 51, with respect to the divider 48, and the panels 52 and 53, with respect to the divider 49.

Each of the dividing means 48 and 49 are provided with cut out portions for forming the partitions between the various cells formed within the compartments 2 and 3 of the carrier. For example, the cut out portion 58, in addition to the end flap 59, are bent outwardly approximately perpendicularly with respect to the panel 53 for adherence, by means of their flaps, against the side wall 30 for forming a row of cells at this outer portion of the carrier. In addition, the cut out portions 60, in addition to the bent back portion 61 are folded outwardly approximately perpendicularly from the panel 52, and are adhered along their flaps 62 and 63 to the surface of the central forming panel 5. Thus, these portions form the cells for the inner row of the carrier provided within the compartment 3 to one side of the carrier. In addition, the cut out portions 64 and 65, in addition to their bent back portions 66 and 67, may be bent approximately 90° outwardly from their respective panels 50 and 51, and secured to either the inner surface of the side wall 29, or the central forming panel 4, by means of their flaps 67*a*, for forming the pair of rows of cells for holding articles at the opposite side compartment 2 of this carrier.

Figure 5:
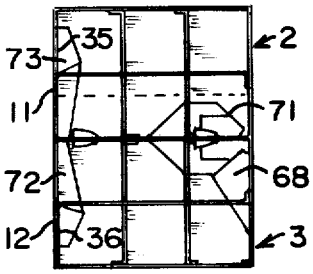
FIG. 5 provides a top view of the container carrier as shown fully folded in FIG. 1.
Figure 6:
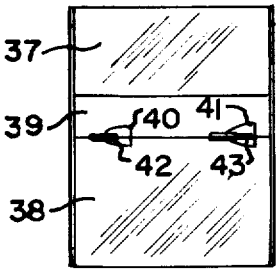
FIG. 6 provides a bottom view of the folded carrier shown in FIG. 1.

Various reinforcement is provided to the bottom of this carrier, and this is achieved through the formation of gussets formed during bending of the various walls and panels of the carrier into its useable configuration. The gusset 68 attaches intermediate the central forming panel 4, and the other end wall 19, such that when the said panel end wall is folded approximately perpendicularly, during formation of the carrier, the gusset likewise double folds along the lines 69 and 70 for forming a reinforcement in the vicinity as shown in FIG. 5. Similarly, the gusset 71 is folded in a related manner when the central panel 5 and its adjacent end wall 20 are folded into the carrier configuration. Furthermore, the gussets 72 and 73, with their shown fold lines, are likewise folded into providing for reinforcement proximate the bottom wall of the carrier, such as also shown in FIG. 5, when it is assembled into its useable configuration. Thus, and as can be seen, further structural reinforcement is provided at approximately each end at the lower segment of the compartment 2 and 3 through the use of the aforesaid gussets 70 through 73 when the carrier is folded into its assembled disposition, and likewise, the gussets further tend to rigidify the erection of the various walls and panels of the carrier during its various stages of assembly.

Figure 3:
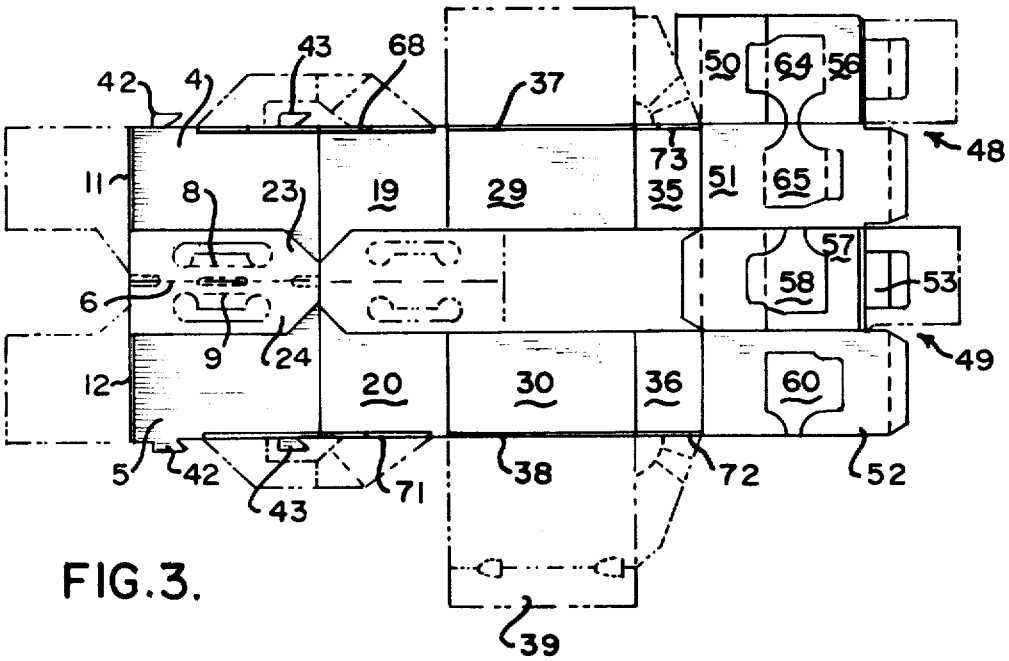
FIG. 3 discloses the carrier blank with particular panels, walls, and gussets being folded into various angular relationships during the initial stages of folding of the carrier into its useable configuration.
Figure 4:
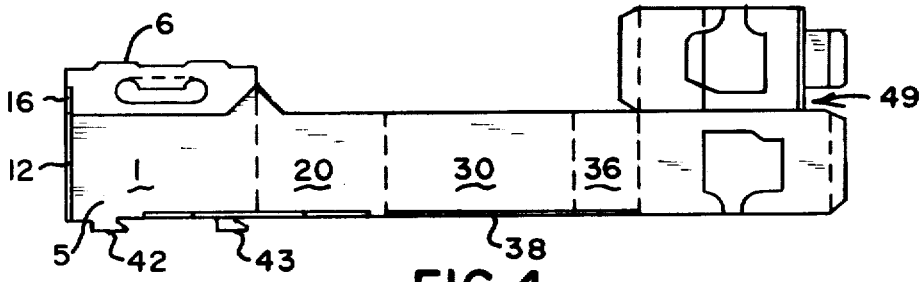
FIG. 4 discloses a side view of the folding blank during its formation into the container carrier.

An example of the various stages of assembly of this multi-celled container carrier can be seen from FIGS. 3 and 4, wherein in the initial stages of assembly the end walls 11 and 12 may be bent upwardly approximately 90°, with the hand gripping reinforcing members 23 and 24, being bent over approximately 180° and adhered in overlying relationship proximate the intended upper portions of the central forming pair of panels 4 and 5, and more specifically, into alignment with the hand apertures 8 and 9. In addition, the gussets 68 and 71 will have been bent upwardly approximately 90°, and in addition, the bottom walls 37 and 38 will likewise have been bent up into the same angular position. During the bending of the said bottom walls 37 and 38 into their erected position, the gussets 72 and 73 will likewise bend upwardly. The spacer portions 56 and 57 will have been bent over approximately 180°, so as to be in position for enclosure between their respective panels 50 and 51, in forming the divider means 48, and the panels 52 and 53 forming the midpanel for the divider means 49. The next stage in the formation of the carrier is to provide for its bending along the fold line 6, so that the panels 4 and 5 enter into juxtaposition for forming the main central panel 1 of the carrier. Following this, the end panels 19 and 20 are folded into perpendicularity with respect to their respective central forming panels 4 and 5, and then the side walls 29 and 30 are folded back into parallel arrangement with the central panel 1, with the connecting flaps 35 and 36 also folding 90° for adherence against a part of the inner surface of their respectively contiguous end walls 11 and 12. Then, the various divider means 48 and 49, in addition to their integral cut out portions and bent back portions, as previously described, are bent into the configuration of the arranged cells for forming the rows of article holding parts of the compartments 2 and 3 of the carrier. At the same time, the bottom walls 37 and 38 will enter into a slight overlapping position at the location of the panel 39, adhered together at this location, with their apertures 40 and 41 being inserted onto the detents 42 and 43 for retention of the said bottom walls proximate the lower part of the central panel 1.

Variations in the structure and formation of the carrier of this invention, in addition to the configuration of its unitized blank, may occur to those skilled in the art upon reviewing the subject matter of this disclosure. Any such variations, if within the spirit and scope of this invention, and encompassed by the claims appended hereto, are intended to be protected by any United States patent issuing upon this invention. The description of the preferred embodiment set forth herein is provided for illustrative purposes only.

Having thus described the invention what is claimed and desired to be secured by Letters Patent is:

1. A multi-celled container carrier for use in the conveyance of a plurality of articles, comprising, a central panel providing a division between compartments disposed to either of its sides and furnishing cells for holding a plurality of articles, there being a hand-gripping means disposed upwardly of the central panel to facilitate its conveyance, said central panel being formed from a pair of panels, with said pair of panels being pivotally connected along their upper edges, said gripping means comprising aligned slots being formed through the upper portion of each of the pair of panels and below their pivotally connected upward edges, a first end wall connecting to one side edge of each of the pair of panels forming the central panel, opposite end walls connecting to the other side edge of each of the pair of panels of the central panel, side walls connecting to the other side edges of each of the opposite end walls, connecting flaps provided at the other edges of the said side walls, said connecting flaps securing with their proximate first end walls, a bottom wall connecting with the lower edge of each side wall, with the inner edge of each bottom wall being secured proximate the lower edges of the said pair of panels forming the central panel, the said bottom walls, end walls, and the side walls forming the said compartments to either side of the formed central panel, divider means provided at each side of the central panel within the said compartments, each divider means arranging at least a pair of rows of cells at either side of the said central panel for holding and conveying of the said plurality of articles during carrier usage, and said pairs of rows of cells provided to either side of the central panel and within the formed compartments being arranged in parallel with respect to said central panel.

2. The invention of claim 1 and wherein said connecting flaps secure within their respective formed compartments, and each said divider means attaches to a connecting flap provided in the compartment formed to either side of the carrier.

3. The invention of claim 2 wherein a gusset interconnects between a central panel and end wall at each side of the carrier to reinforce it during carrier erection and usage.

4. The invention of claim 3 wherein another gusset interconnects between a connecting flap and the bottom wall within each formed compartment of the carrier.

5. The invention of claim 2 wherein a gusset interconnects between a connecting flap and the bottom wall at each side of the carrier to reinforce it during carrier erection and usage.

6. The invention of claim 2 and wherein each divider means includes a midpanel extending between and connecting with the end walls, and a series of partitions extending from both sides of each midpanel for attachment with one of the said side wall and central panel to divide each side formed compartment into cells for holding a plurality of articles.

7. The invention of claim 6 and wherein there are three article holding cells in each divider means formed row, with a total of twelve disposed cells in the formed container carrier.

8. The invention of claim 6 and wherein each midpanel comprises a pair of pivotally connected panels, and cutouts formed from each of the panels and projecting perpendicularly therefrom for forming the said cellular partitions.

9. The invention of claim 8 and including an integral spacer connecting with one of the said pair of panels and arranged intermediate thereof for enhancing the separation of the rows forming the compartment cells.

10. The invention of claim 1 and including at least one integral detent formed at the bottom edge of the central panel, said detent disposed through an aperture formed in a bottom wall to hold the same together.

11. The invention of claim 10 and wherein the said bottom walls connecting with each side wall are also adhered together.

12. The invention of claim 1 and including additional handle panels foldably connected approximately laterally of the upper portion of the central panel and being turned and secured in overlying relationship therewith for furnishing reinforcement at the vicinity of the hand-gripping means.

13. A blank for a multi-celled container carrier of the type for use in the conveyance of a plurality of articles, comprising, a central panel, a pair of panels foldably connected at their intended upper edges forming the said central panel, there being aligned apertures formed through each of the said pair of panels and disposed for forming the hand gripping means for the carrier when erected, first end walls foldably connecting to one side edge of each pair of central forming panels, opposite end walls foldably connecting to the other side edges of the pair of central forming panels, side walls foldably connected to the other side edges of the said opposite walls, a connecting flap securing with each side wall, said connecting flaps capable of attachment with their associated first end walls, a bottom wall foldably connecting with each side wall and folded inwardly for attachment with the proximate bottom of the central panel therein, said bottom walls forming in conjunction with the end and side walls the article holding compartments to either side of the said central panel, and divider means foldably securing to each connecting flap and capable of folding into disposition within each compartment for forming a pair of rows of article holding cells to either side of the central panel.

14. The blank of claim 13 and wherein each divider means includes a midpanel which when folded capable of extending between end walls, said midpanel incorporating cutout sections capable of forming partiions extending from both sides of said midpanel and capable of attachment with one of the said side wall and central panel for dividing each side wall compartment into cells for holding a plurality of articles.

15. The blank of claim 14 and wherein each midpanel comprising a pair of panels, and the cutout sections formed of each panel capable of projecting perpendicularly therefrom, for forming the said cellular partitions.

16. The blank of claim 15 and including an integral spacer panel connecting with one of said pair of panels forming each midpanel, and said spacer panel capable of folding intermediate the said pair of panels forming the midpanel for enhancing the separation of the compartment cells.

17. The blank of claim 13 and including detent means extending from the intended lower edge of at least one of the pair of panels forming the central panel, and there being apertures formed through at least one of the bottom walls and capable of alignment and connection with the aforesaid detent means for retention of the said bottom walls proximate the lower edge of the central panel when the container blank is folded into its carrier configuration.

18. The blank of claim 13 and including additional handle panels foldably connected with the intended upper portion of the pair of panels forming the central panel and capable of securing therewith when the central panel is formed into the carrier configuration for furnishing reinforcement in the vicinity of its hand gripping means.

19. The blank of claim 13 and including gussets connecting between the said end walls and central panel for reinforcing the container when formed.

20. The blank of claim 13 and including gussets connecting between the said bottom walls and connecting flaps for reinforcing the container when formed.

* * * * *